US008855346B2

(12) United States Patent
Barti et al.

(10) Patent No.: US 8,855,346 B2
(45) Date of Patent: Oct. 7, 2014

(54) HEARING DEVICE WITH REDUCED ACOUSTIC FEEDBACK DUE TO VIBRATION-RELATED SHORTENING OF THE HEARING DEVICE

(75) Inventors: Endre Barti, München (DE); Hartmut Ritter, Neunkirchen am Brand (DE); Michael Sattler, Bubenreuth (DE); Christian Weistenhöfer, Bubenreuth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 134 days.

(21) Appl. No.: 13/453,330

(22) Filed: Apr. 23, 2012

(65) Prior Publication Data

US 2012/0269370 A1 Oct. 25, 2012

(30) Foreign Application Priority Data

Apr. 21, 2011 (DE) ..... 10 2011 007 848

(51) Int. Cl.
*H04R 25/00* (2006.01)

(52) U.S. Cl.
USPC ..... 381/323; 381/322; 381/324

(58) Field of Classification Search
USPC ..... 381/322, 324, 328, 330, 380–38.1
See application file for complete search history.

(56) References Cited

U.S. PATENT DOCUMENTS

| | | | | |
|---|---|---|---|---|
| 6,700,983 | B1 * | 3/2004 | Bøgeskov-Jensen et al. | 381/322 |
| 8,462,971 | B2 | 6/2013 | Gommel et al. | |
| 2005/0152566 | A1 | 7/2005 | Mehr et al. | |
| 2008/0085024 | A1 | 4/2008 | Linkenkaer-Hansen et al. | |
| 2009/0161897 | A1 | 6/2009 | Fickweiler et al. | |
| 2010/0111341 | A1 | 5/2010 | Dittli et al. | |
| 2010/0208927 | A1 | 8/2010 | Ritter et al. | |

FOREIGN PATENT DOCUMENTS

| | | | |
|---|---|---|---|
| CH | 699 444 | B1 | 3/2010 |
| DE | 102 48 755 | A1 | 5/2004 |
| DE | 102007023054 | A1 | 11/2008 |
| DE | 102007061310 | A1 | 6/2009 |
| WO | 03/088710 | A1 | 10/2003 |

OTHER PUBLICATIONS

German Patent and Trademark Office, Office Action Dated Dec. 15, 2011.

* cited by examiner

*Primary Examiner* — Suhan Ni
(74) *Attorney, Agent, or Firm* — Laurence A. Greenberg; Werner H. Stemer; Ralph E. Locher

(57) ABSTRACT

A hearing device has a housing, in which a loudspeaker and a battery are disposed. The housing has a first housing part and a second housing part. The housing parts are connected to one another by way of a connection. At least one housing part or an attenuation element provided in the connection between the housing parts is formed of an elastic material.

16 Claims, 5 Drawing Sheets

HEARING DEVICE WITH REDUCED ACOUSTIC FEEDBACK DUE TO VIBRATION-RELATED SHORTENING OF THE HEARING DEVICE

CROSS-REFERENCE TO RELATED APPLICATION

This application claims the priority, under 35 U.S.C. §119, of German patent application DE 10 2011 007 848.7, filed Apr. 21, 2011; the prior application is herewith incorporated by reference in its entirety.

BACKGROUND OF THE INVENTION

Field of the Invention

The invention relates to a hearing device.

Hearing devices produce acoustic feedback, which is caused by various structural features. Two main features which influence feedback are the weight and the length of the hearing device. Therefore powerful hearing devices (known as super power devices) in particular with a high level of amplification and heavy batteries tend to produce feedback in the acoustic range between 2 and 6 kHz. In almost all instances therefore it is impossible to achieve adequate amplification in directional microphone mode. Such hearing devices are generally embodied as behind the ear (BTE) hearing devices and have a housing which is supported behind the ear by means of a hook. The housing encloses the loudspeaker (earpiece) and accommodates one or more batteries to supply power.

All attempts to resolve the feedback problems are based on decoupling the microphone from the housing in which it is suspended or suspending the loudspeaker so that as much vibration energy as possible is absorbed by the hooks, which are shaped specifically for the application and made of soft rubber material (cf. US 2010/0208927 A1). These designs have physical limits and are generally not sufficient to achieve a high level of amplification in directional microphone mode. To date there has only been one known apparatus (Sumo by Oticon) with an extremely stable omnidirectional mode, which does not however offer a directional microphone mode. There is also a special hook design (cf. US 2008/0085024 A1), which reduces vibration. That solution may be adequate for smaller and less powerful apparatuses, but more powerful devices require different solutions.

SUMMARY OF THE INVENTION

It is accordingly an object of the invention to provide a reduction of acoustic feedback in a hearing device which overcome the above-mentioned disadvantages of the heretofore-known devices and methods of this general type and which provides for a device with reduced feedback that is achieved by vibration-related shortening of the hearing device.

With the foregoing and other objects in view there is provided, in accordance with the invention, a hearing device, comprising:

a housing having a first housing part, a second housing part, and a connection connecting the first and second housing parts to one another;

an loudspeaker and a battery disposed in the housing;

wherein at least one housing part or an attenuation element provided in the connection between the first and second housing parts is formed of an elastic material.

In other words, the objects of the invention are achieved in that there is provided a hearing device with a housing, in which an loudspeaker and a battery are disposed, wherein the housing has a first housing part and a second housing part, which are connected to one another by way of a connection, with at least one housing part or an attenuation element provided in the connection being formed of an elastic material.

The attenuation element may, for example, be an annular or disk-type attenuation element. The attenuation element is preferably disposed between the first and second housing parts.

In a preferred implementation, the hearing device is a behind the ear hearing aid with a hook.

It is preferable for the hook to form the second housing part, which is connected by way of a connection to the first housing part, and wherein an attenuation element is disposed in the connection. According to an added feature of the invention, the first housing part is formed of an elastic material.

It is preferable for the battery to be disposed in the first housing part.

It is also preferable for the loudspeaker to be disposed in the second housing part.

It is a particularly preferred implementation of the invention for the battery to be disposed in the first housing part and for the earpiece loudspeaker to be disposed in the second housing part.

In accordance with an added feature of the invention, the second housing part is formed of a non-elastic material. Preferably, the non-elastic material may be a duroplastic, in particular ABS.

In accordance with another feature of the invention, the elastic material may be an elastomer plastic, e.g. silicone rubber, a thermoplastic elastomer (TPE) or a fluoropolymer elastomer such as Viton® (trademark owned by DuPont).

It is preferable for the connection between the first and second housing parts to be a plug-type connection, a screw connection or a bayonet connection.

Heavy weight and the length of the housing are the main factors for significant feedback in a hearing device. This is true in particular of heavy, powerful devices.

Two components in particular contribute to the heavy weight of heavy, powerful devices: the battery and the loudspeaker. Their weight cannot be reduced without loss of performance. It is however possible to accommodate these two components in separate, decoupled housing parts. This results in a hearing device with two parts, which vibrate independently of one another and the feedback frequencies are displaced into a higher frequency range (≥6 kHz). This is very effective, as both length and weight are reduced in respect of vibration by the separation. Decoupling can be achieved by an attenuation element, which is disposed between the first and second housing parts, e.g. a ring or disk made of attenuating material, e.g. an elastomer material. Alternatively one housing part, preferably the part containing the battery, can be made of an attenuating material, e.g. an elastomer material. The other housing part can hold the microphone and loudspeaker and be made of a rigid, non-elastic material, e.g. a duroplastic material or a rigid thermoplastic material.

Surprisingly the inventors have found that the decoupling of the hook from the remainder of the housing by means of a connection containing an attenuation element is an effective measure for reducing feedback. Even more effective attenuation is possible if the housing is divided into two housing parts, with the battery being accommodated in one housing part and the loudspeaker being accommodated in the other housing part and with one housing part being made of an elastic or soft attenuating material or an attenuation element being disposed between the two housing parts. The embodiment with a housing part made of an elastic or soft attenuating material has proved in tests to be the most effective measure for suppressing feedback.

Other features which are considered as characteristic for the invention are set forth in the appended claims.

Although the invention is illustrated and described herein as embodied in a Reduction of acoustic feedback by vibration-related shortening of the hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
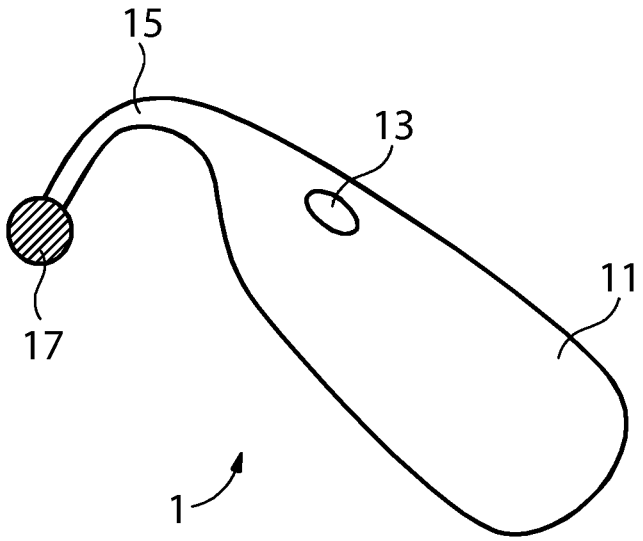
FIG 1 PRIOR ART
FIG. 1 is a view of a hearing device according to the prior art.

Referring now to the figures of the drawing in detail and first, particularly, to FIG. 1 thereof, there is shown a schematic diagram of a BTE hearing device 1 according to the prior art. The device 1 has a rigid housing 11, a microphone opening 13, a hook 15 and a connector 17 for a hearing tube (not illustrated), which conducts the sound (from a loudspeaker in the housing) into the ear. The housing 11 is configured as a single part, integrally formed with the hook 15.

Figure 2:
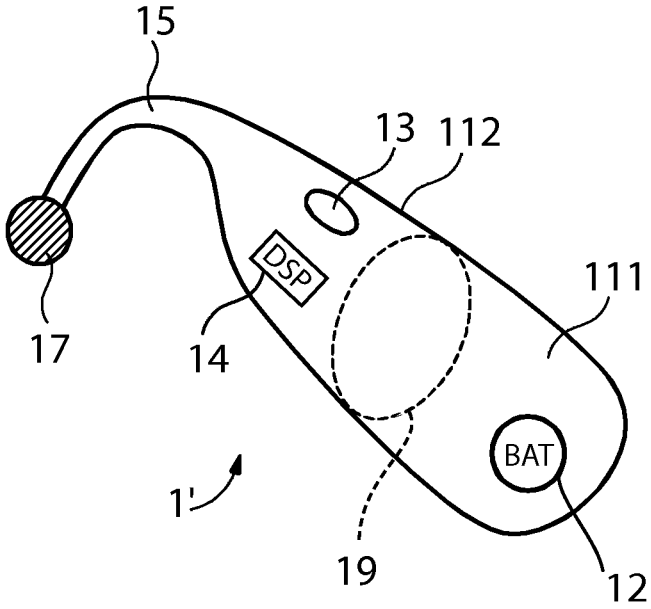
FIG. 2 is a schematic view of a first embodiment of a hearing device according to the invention.

FIG. 2 shows a schematic diagram of a first embodiment of an inventive hearing device 1', with a first housing part 111 and second housing part 112. A battery 12 (BAT) is disposed in the first housing part 111. Disposed in the second housing part 112 are the microphone behind a microphone opening 13 and an earpiece 14 (indicated here as a digital signal processing device, DSP). The first housing part 111 is made of an elastomer plastic, e.g. TPE. The connection 19 is embodied as a simple plug-type or latching connection.

Figure 3:
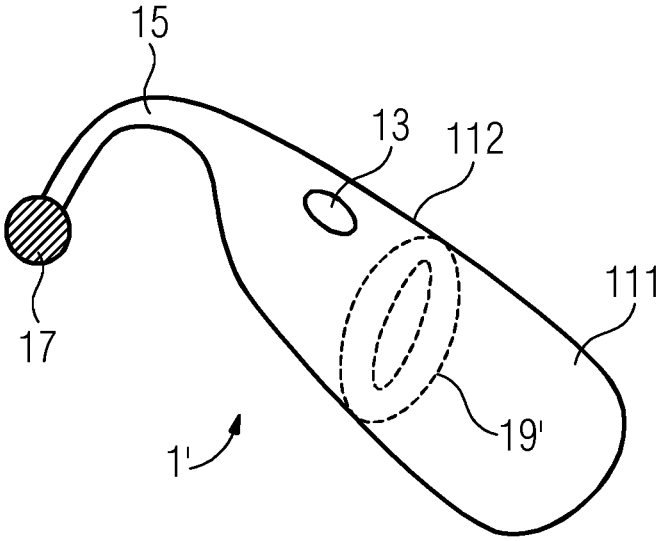
FIG. 3 shows a second embodiment of a hearing device according to the invention.

FIG. 3 shows a schematic diagram of a second embodiment of an inventive hearing device 1', with a first housing part 111 and second housing part 112. Disposed in the first housing part 111 is a battery (not shown). Disposed in the second housing part 112 are the microphone 13 and the earpiece (not shown). The first housing part 111 is made of a duroplastic. The connection 19' is embodied as a simple plug-type connection, with an attenuation element made of an elastomer material disposed between the first housing part 111 and the second housing part 112.

Figure 4:
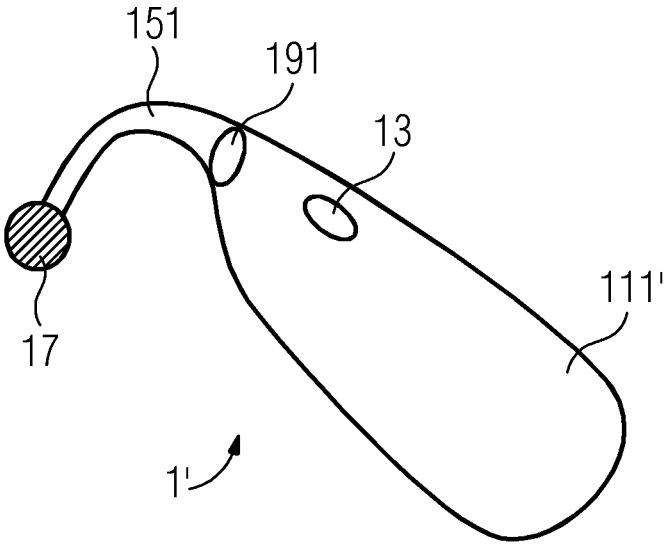
FIG. 4 shows a third embodiment of a hearing device according to the invention.

FIG. 4 shows a schematic diagram of a third embodiment of an inventive hearing device, in which the hook 151 is connected by way of an attenuated connection 191 to the first housing part 111'. Disposed in the first housing part 111' are a battery (not shown) and the loudspeaker (not shown).

Figure 5:
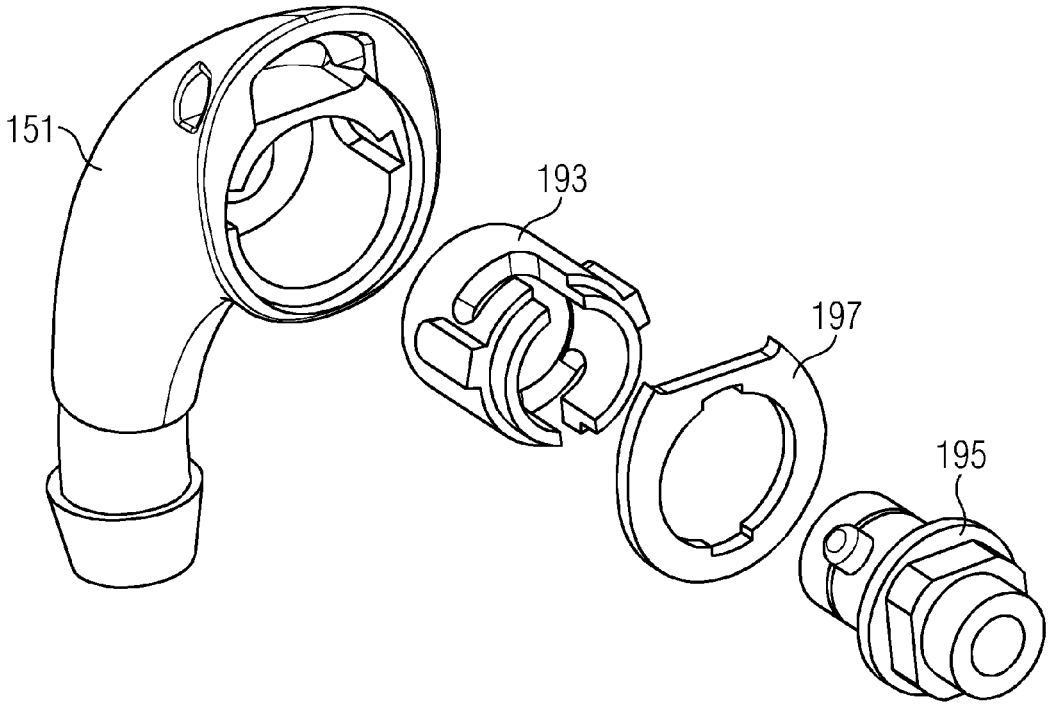
FIG. 5 is an exploded perspective view of the hook with a connecting element according to the third embodiment of the hearing device according to the invention.

FIG. 5 shows the hook 151 with connecting elements 193, 195, 197 according to the third embodiment from FIG. 4. The connection here comprises an attenuation element 193 made of an attenuating soft material, e.g. TPE, and first connecting element 195, which interact in the manner of a bayonet lock. Disposed in between is a second connecting element 197. The hook 151 and the remainder of the housing are thus decoupled from one another.

Figure 6:
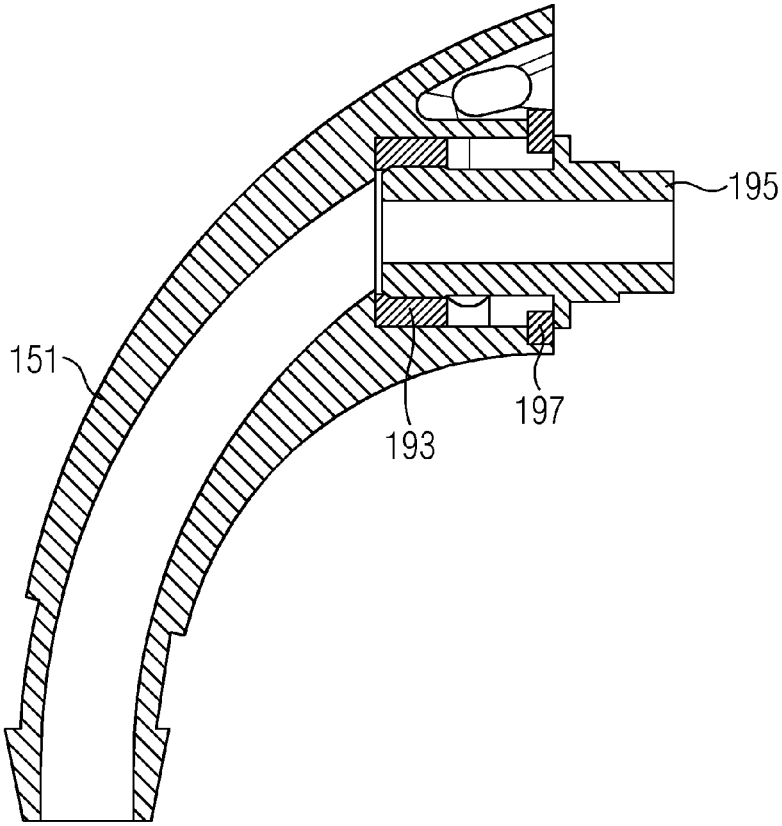
FIG. 6 is a longitudinal sectional view of the hook with the connecting element according to the third embodiment of the hearing device.

FIG. 6 shows a sectional view of the hook 151 with connecting elements 193, 195, 197 according to the third embodiment from FIGS. 4 and 5.

Figure 7:
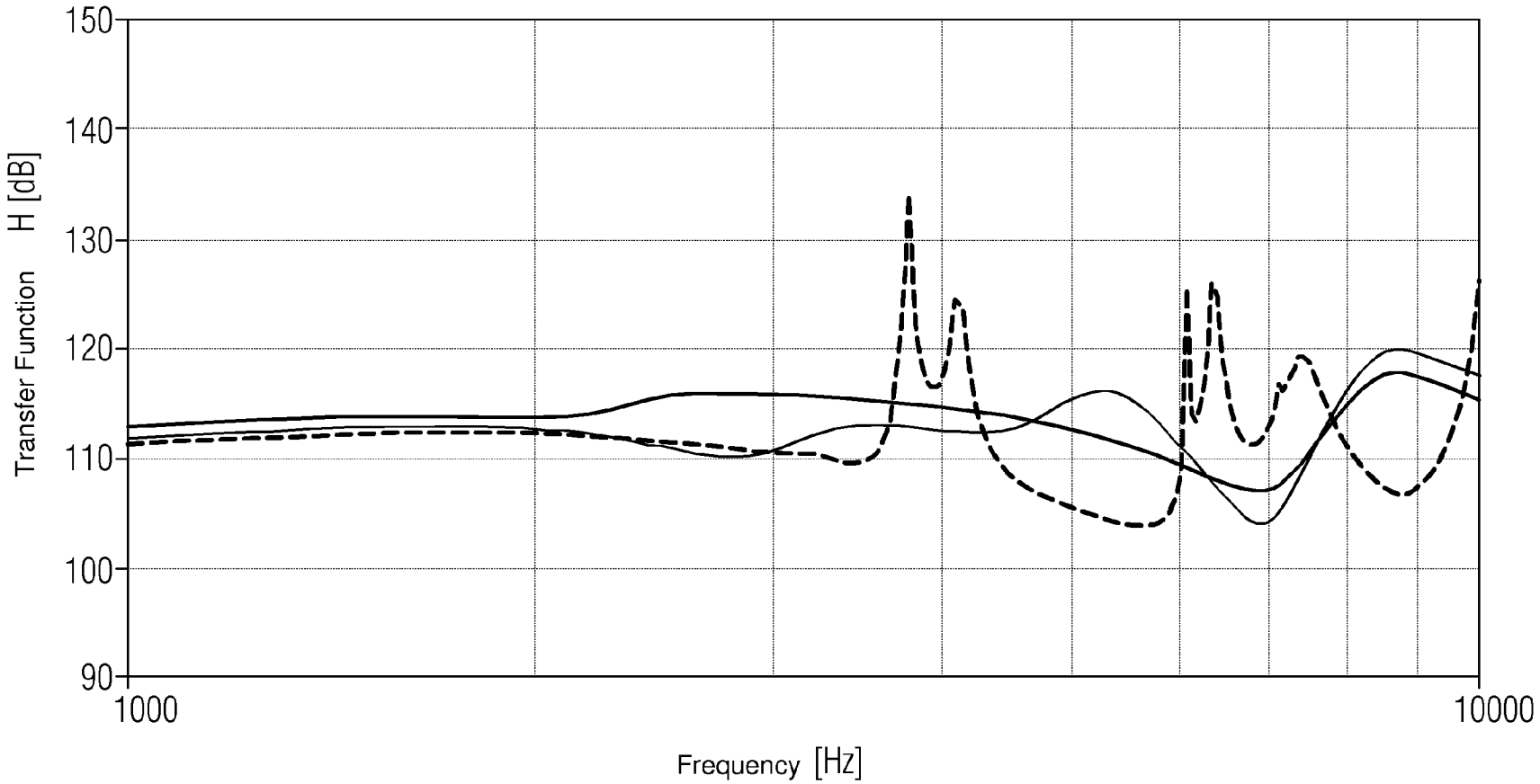
FIG. 7 is a diagram illustrating the feedback behavior of the hearing device according to the embodiment shown in FIG. 2.

FIG. 7 shows a diagram illustrating the feedback behavior of the inventive hearing device according to the embodiment in FIG. 2. This embodiment has a first housing part made of elastic and attenuating material, which encloses the battery of the hearing device. The broken line shows the feedback behavior of a hearing device with a single-piece, rigid housing according to the prior art. High maximums of the transmission function can be seen at approx. 4 kHz and 6-7 kHz, indicating feedback in these frequency ranges (the ideal would be a linear frequency pattern without minimums or maximums). The continuous thick line shows the feedback behavior of an inventive hearing device with a first housing part made of elastic and attenuating material. The continuous thin line shows the feedback behavior of an inventive hearing device with a first housing part made of elastic and attenuating material and an attenuation element between the hook and the remainder of the housing, corresponding to a combination of the features of the embodiments in FIG. 2 and FIG. 4. It can be seen from the inventive hearing devices that the sharply defined maximums at approx. 4 kHz and 6-7 kHz are no longer present and the frequency pattern is generally much closer to the desired ideal frequency pattern.

Figure 8:
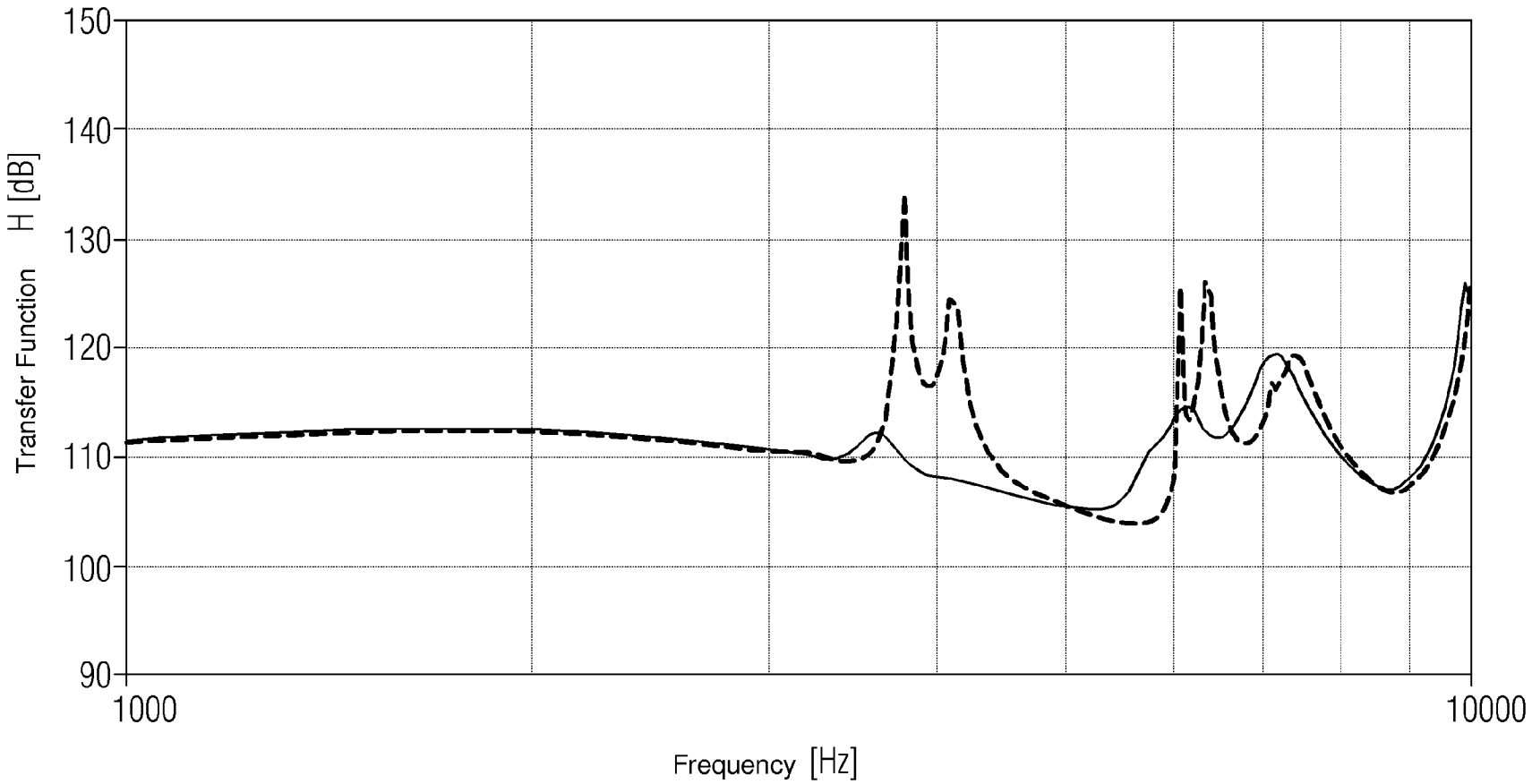
FIG. 8 is a diagram illustrating the feedback behavior of the inventive hearing device according to the embodiment shown in FIG. 4.

FIG. 8 shows a diagram illustrating the feedback behavior of the inventive hearing device according to the embodiment in FIGS. 4 to 6. This embodiment has an attenuation element between the hook and the remainder of the housing. The broken line shows the feedback behavior of a hearing device according to the prior art with a single-piece, rigid housing. High maximums of the transmission function can be seen at approx. 4 kHz and 6 kHz. The continuous thin line shows the feedback behavior of the inventive hearing device with an attenuation element between the hook and the remainder of the housing, corresponding to the embodiment in FIGS. 4 to 6. It can be seen that the sharply defined maximums at approx. 4 kHz and 6 kHz are no longer present and the frequency pattern is generally much closer to the desired ideal frequency pattern. This attenuation measure is also surprisingly suitable for minimizing feedback effectively, although the structure with one housing part made of an elastic or soft attenuating material is even more effective (see FIG. 7, where the feedback at approx. 6-7 kHz is completely suppressed).

The invention claimed is:

1. A behind-the-ear hearing device, comprising:

a housing to be worn behind the ear of a hearing device wearer, said housing having a first housing part, a second housing part, and a connection connecting said first and second housing parts to one another;

a loudspeaker disposed in said second housing part and a battery disposed in said first housing part;

wherein at least one housing part or an attenuation element provided in said connection between said first and second housing parts is formed of an elastic material.

2. The hearing device according to claim 1, configured as a behind the ear hearing device with a hook.

3. The hearing device according to claim 2, wherein said hook is said second housing part, which is connected by way of said connection to said first housing part, and wherein an attenuation element is disposed in said connection between said hook and said first housing part.

4. The hearing device according to claim 2, wherein said first housing part is formed of an elastic material.

5. The hearing device according to claim 1, wherein said first housing part is formed of an elastic material.

6. The hearing device according to claim 1, wherein said battery is disposed in said first housing part.

7. The hearing device according to claim 1, wherein said loudspeaker is disposed in said second housing part.

8. The hearing device according to claim 1, wherein said second housing part is formed of a non-elastic material.

9. The hearing device according to claim 8, wherein said non-elastic material is a duroplastic.

10. The hearing device according to claim 9, wherein said non-elastic material is ABS.

11. The hearing device according to claim 1, wherein said elastic material is an elastomer plastic, TPE, or Viton®.

12. The hearing device according to claim 1, wherein said elastic material is silicone rubber.

13. The hearing device according to claim 1, wherein said connection is selected from the group consisting of a plug connection, a screw connection, and a bayonet connection.

14. A behind-the-ear hearing device, comprising:

a housing to be worn behind the ear of a hearing device wearer, said housing having a first housing part, a second housing part, and a connection connecting said first and second housing parts to one another;

a loudspeaker and a battery disposed in said housing; and wherein at least one of said housing parts or an attenuation element provided in said connection between said first and second housing parts is made of an elastic material configured to enable said first and second housing parts to vibrate independently of one another.

15. The hearing device according to claim 14, wherein said battery is disposed in said first housing part and said loudspeaker is disposed in said second housing part.

16. The hearing device according to claim 14, wherein said first housing part is formed of an attenuating elastic material and said second housing part is formed of a non-elastic material.

* * * * *